United States Patent [19]

Roach

[11] 4,279,739

[45] Jul. 21, 1981

[54] PROCESS FOR SEPARATING BITUMINOUS MATERIALS

[75] Inventor: Jack W. Roach, Oklahoma City, Okla.

[73] Assignee: Kerr-McGee Refining Corporation, Oklahoma City, Okla.

[21] Appl. No.: 164,606

[22] Filed: Jun. 30, 1980

[51] Int. Cl.[3] ..... C10C 3/00; C10G 21/78; B01D 3/38

[52] U.S. Cl. ..... 208/309; 208/321; 208/363

[58] Field of Search ..... 208/45, 309, 363, 356, 208/321

[56] References Cited

U.S. PATENT DOCUMENTS

| | | | |
|---|---|---|---|
| 2,041,275 | 5/1936 | Bray | 208/309 |
| 2,041,278 | 5/1936 | Aldridge | 208/309 |
| 2,940,920 | 6/1960 | Garwin | 208/309 |
| 3,403,093 | 9/1968 | Mills | 208/45 |
| 3,830,732 | 8/1974 | Gatsis | 208/309 |
| 4,101,415 | 7/1978 | Crowley | 208/45 |
| 4,125,459 | 11/1978 | Garwin | 208/309 |

*Primary Examiner*—Brian E. Hearn
*Attorney, Agent, or Firm*—William G. Addison

[57] ABSTRACT

A process for separating a solvent from a bituminous material by pressure reduction and steam stripping without carry-over of entrained bituminous material. The fluid-like phase of bituminous material and solvent is reduced in pressure and introduced into a steam stripper. The solvent vaporizes upon pressure reduction and a mist of fine bituminous material particles forms and becomes dispersed in the vaporized solvent. The vaporized solvent and associated mist is separated from the bituminous material in the stripper and is withdrawn from the steam stripper and introduced into a condenser. The solvent and steam from the stripper condense, a substantial portion of the mist of entrained particles solidifies and an emulsion of water and fluid-like bituminous material from the mist forms. The liquid stream is withdrawn from the condenser and introduced into a separator. The liquid stream separates in the separator into an upper fraction comprising solvent, a middle fraction comprising emulsion and a lower fraction comprising water and the solidified particles of bituminous material. The liquid solvent is removed by passage over a weir in the separator and recovered. The emulsion, water and solids can be removed from the base of the separator for disposal.

23 Claims, 2 Drawing Figures

PROCESS FOR SEPARATING BITUMINOUS MATERIALS

BACKGROUND OF THE INVENTION

1. Field of the Invention

This invention relates to a improved process for separating bituminous materials into various fractions employing solvents at elevated temperatures and pressures.

2. Brief Description of the Prior Art

Many methods for extracting various fractions from bituminous materials have been disclosed previously in the prior art, perhaps the most well known of these being termed "propane extraction" in which asphaltic materials are extracted or recovered from heavy hydrocarbon materials such as reduced crudes by means of a single solvent extraction step using propane as the extractant.

U.S. Pat. No. 2,940,920, assigned to the same assignee as the present invention, discloses that solvents other than propane can be used to separate heavy hydrocarbon materials into at least two fractions at a greatly improved rate of separation and in a manner which eliminates certain prior art operating difficulties encountered in the use of propane type solvents ($C_2$ to $C_4$ hydrocarbon solvents). That patent discloses effecting the separation by using high temperature-pressure techniques and by using pentane as one of a group of suitable solvents. Such practice permits a deeper cut to be made in the heavy hydrocarbon material.

U.S. Pat. No. 4,125,459, assigned to the same assignee as the present invention, discloses a process for separating a heavy hydrocarbon material into three fractions by using a combination of propane and pentane deasphalting techniques. That process includes (i) mixing the heavy hydrocarbon material with pentane at elevated temperatures and pressures to produce a light fraction containing resins and oils, (ii) mixing the light fraction with propane at high temperatures and pressures to produce a second light fraction comprising oils and a second heavy fraction comprising resins and (iii) recycling at least a portion of the resins fraction back to the pentane deasphalting process. Alternatively, that process may be carried out by subjecting the heavy hydrocarbon material first to a propane deasphalting process to produce a heavy fraction containing asphaltenes and resins, followed by a pentane deasphalting process on the asphaltene-resin fraction previously obtained to produce a second light fraction comprising resins and a second heavy fraction comprising asphaltenes and recycling at least a portion of the resins fraction back to the propane deasphalting process.

U.S. Pat. No. 3,830,732 discloses a two solvent extraction process for producing three fractions from a hydrocarbon charge stock containing asphaltenes, resins and oils. The charge stock is admixed with a first solvent in a volumetric ratio of solvent to charge stock of less than about 4:1 to form a mixture that is introduced into a first extraction zone maintained at an elevated temperature and pressure. The mixture separates within the first extraction zone to produce a first solvent-rich liquid phase containing oils which are free of asphaltenes and resins and a first solvent-lean liquid phase containing asphaltenes and resins. The solvent-lean liquid phase then is contacted with a second solvent containing at least one more carbon atom per molecule than said first solvent and introduced into a second extraction zone. The second extraction zone is maintained at a lower temperature and pressure than the first extraction zone to separate the solvent-lean liquid phase into a second solvent-rich liquid phase containing resins and a second solvent-lean liquid phase containing asphaltenes.

U.S. Pat. No. 4,101,415 discloses a single solvent extraction process for separating a heavy hydrocarbon material into three different fractions by a process employing a two stage solvent treatment wherein different solvent to feed ratios and different temperatures are used in each stage. The charge stock is admixed with the solvent in a volumetric ratio of solvent to feed in the range of 2:1 to 10:1 and introduced into a first extraction zone maintained under temperature and pressure conditions sufficient to cause the mixture to separate into a first solvent-rich fraction containing oils and a first solvent-lean fraction containing asphaltenes and resins. The solvent-lean fraction then is contacted with an additional portion of the solvent and introduced into a second extraction zone maintained at a temperature and pressure lower than in the first extraction zone to cause asphaltic solids to form. The soluble material then is separated from the asphaltic solids.

In many of the prior art separation processes, the solvent is separated from the various products by either or both pressure reduction and steam stripping. The solvent is vaporized by such treatment, separated from the bituminous product and condensed for recycle in the separation process.

It has been observed that in some instances a portion of the bituminous material introduced into the steam stripping apparatus is carried out of the steam stripper in the form of a fine mist with the vaporized solvent and steam. When the solvent and steam are condensed, at least a portion of the mist solidifies and an emulsion of water and bituminous material is formed. The emulsion and solids settle within the process apparatus. The settling solids ultimately plug the apparatus and cause a disruption of the bituminous separation process.

SUMMARY OF THE INVENTION

The discovery now has been made that it is possible to separate a solvent from a bituminous material by pressure reduction and steam stripping without carryover of fine bituminous material particles or emulsion to the solvent recovery apparatus. The process comprises introducing the mixture of solvent, emulsion and fine particle size bituminous material into a specially designed separator.

Initially, a bituminous feed is admixed with a solvent and introduced into a first separation zone. The first separation zone is maintained at an elevated temperature and pressure to effect a separation of the mixture into a fluid-like first light phase comprising light bituminous material and solvent and a fluid-like first heavy phase comprising heavy bituminous material and solvent. The first light phase is withdrawn from the first separation zone and introduced into a second separation zone for additional processing.

The first heavy phase is withdrawn from the first separation zone and reduced in pressure by passage through a pressure reduction valve. The reduction in pressure causes a substantial portion of the solvent in the first heavy phase and a small portion of the bituminous material to vaporize. The small portion of vaporized bituminous material is that which provides vapor-liquid equalibrium between the vapor and fluid-like phases of the heavy bituminous material in the heavy phase. Unfortunately, the pressure reduction also results in the formation of an undesirable fine particle size mist of a portion of the heavy bituminous material. The resultant mixture of vapor, mist and fluid-like material then is introduced into a steam stripper for separation of the solvent remaining in the fluid-like material. The solvent remaining dissolved in the fluid-like material is vaporized by the steam. The vaporized solvent, vaporized bituminous material, mist and steam then are withdrawn from the steam stripper and introduced into a solvent condenser. The solvent vapor, bituminous material vapor and steam condense, at least a portion of the mist solidifies, and an emulsion of water and bituminous material forms. The liquid stream then is withdrawn from the solvent condenser and introduced into a third separation zone. The solvent is separated for recycle in the process, emulsion, solids and water can be sewered.

DESCRIPTION OF THE PREFERRED EMBODIMENT

Figure 1:
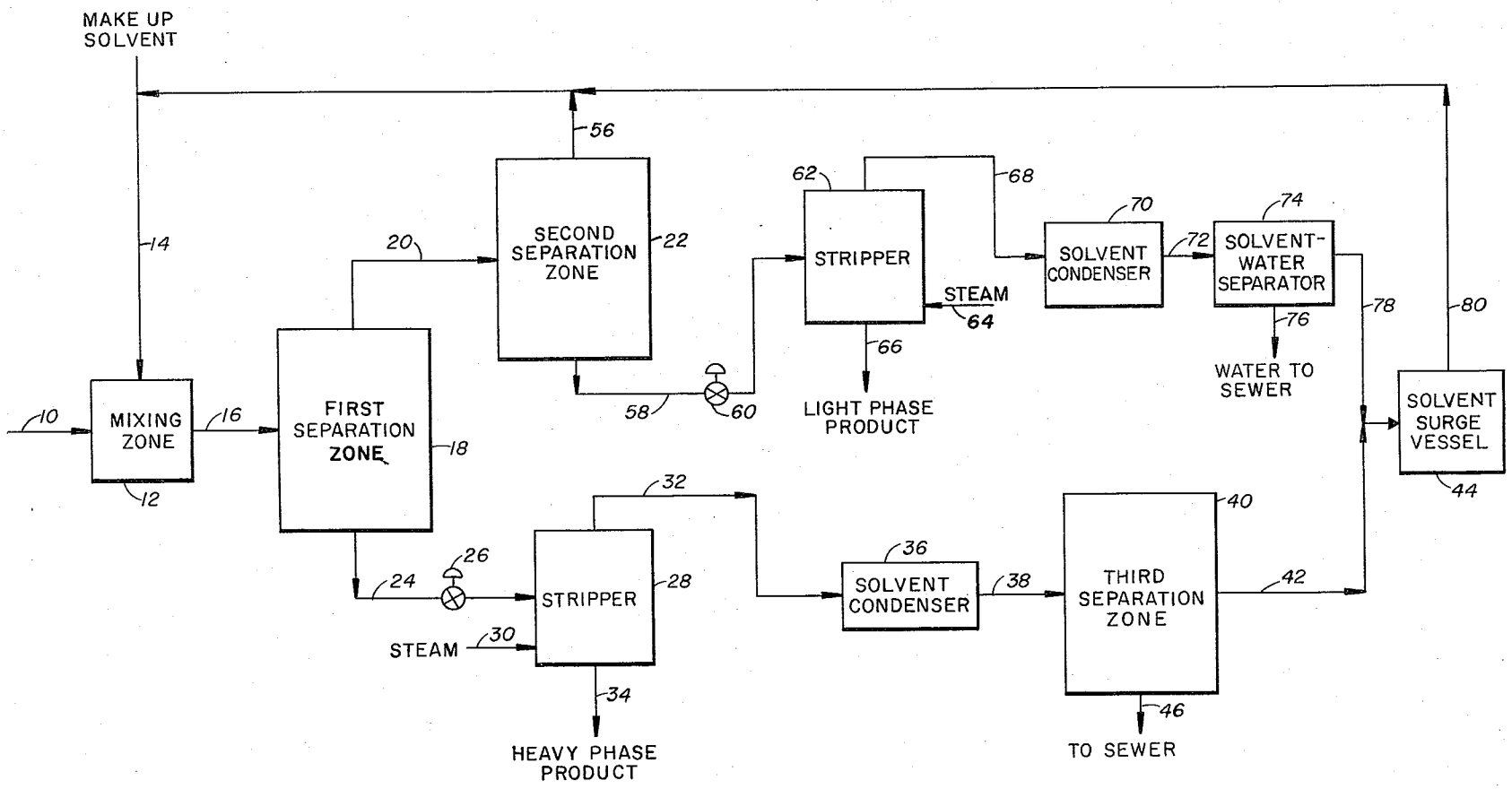
FIG. 1 is a diagrammatic illustration of the process of this invention.

Turning now to FIG. 1, a feed stock comprising a bituminous material is introduced into a mixing zone 12 through a conduit 10. A solvent is introduced into mixing zone 12 through a conduit 14 to contact and admix with the feed to provide a feed mixture. Sufficient solvent is introduced into mixing zone 12 to provide a ratio by volume of solvent to feed in the mixture in the range of from about 2:1 to about 20:1 and preferably in the range of from about 8:1 to about 12:1. It is to be understood that larger quantities of solvent may be used, but such use is unnecessary.

To facilitate an understanding of the process of the present invention, and not by way of limitation, hereinafter specific reference will be made to a bituminous feed comprising an atmospheric residuum containing asphaltenes, resins and oils. The feed mixture comprising atmospheric residuum and solvent is withdrawn from mixing zone 12 and introduced into a first separation zone 18 via a conduit 16. The first separation zone 18 is maintained at an elevated temperature and pressure to effect a separation of the feed mixture into a fluid-like first light phase comprising oils and solvent and a fluid-like first heavy phase comprising asphaltenes, resins and some solvent.

More particularly, first separation zone 18 is maintained at a temperature level in the range of from about 150 degrees F. to above the critical temperature of the solvent. The pressure level of first separation zone 18 is maintained at least equal to the vapor pressure of the solvent when zone 18 is maintained at a temperature below the critical temperature of the solvent and at least equal to the critical pressure of the solvent when maintained at a temperature equal to or above the critical temperature of the solvent. Preferably, the pressure level is maintained above the critical pressure of the solvent.

In an alternate embodiment of the invention (not shown), the feed in conduit 10 and solvent in conduit 14 are introduced directly into first separation zone 18 without prior mixing. Preferably, the feed is introduced into an upper portion of first separation zone 18 and the solvent is introduced into a lower portion of first separation zone 18. The solvent and feed are introduced in the same general volumetric ratios as previously described. The solvent admixes with the feed within first separation zone 18 and the mixture then is caused to separate into the fluid-like first light phase and the fluid-like first heavy phase through control of the temperature and pressure conditions within first separation zone 18.

Referring again to FIG. 1, the first heavy phase is withdrawn from first separation zone 18 through a conduit 24 and reduced in pressure by passage through a pressure reduction valve 26 interposed in conduit 24. Preferably, the pressure level of the first heavy phase is reduced to a level of from about 0 to 50 psig. The pressure reduction vaporizes a substantial portion of the solvent in the first heavy phase, however, a small quantity of solvent remains dissolved in the fluid-like mixture of asphaltenes and resins. The pressure reduction also vaporizes a small portion of the resins and some oils remaining in the asphaltenes and resins in the first heavy phase. The quantity that vaporizes is that which provides vapor-liquid equilibrium between the vapor and liquid portions of the asphaltenes and resins at the reduced pressure level. It also has been observed that the pressure reduction or flashing process which results in vaporization of the solvent and a small portion of resins and some oils remaining in the heavy phase, results in the formation of an undesirable fog or mist of fine particle size fluid-like asphaltenes and resins. The fine particles are dispersed within the vaporized solvent such that they do not readily recombine with the bulk of the fluid-like asphaltenes and resins.

The mixture of solvent vapor, resin and oil vapor, asphaltene and resin mist and fluid-like asphaltenes and resins resulting from the pressure reduction is introduced into a steam stripper 28. Steam is introduced into the bottom portion of stripper 28 by a conduit 30. The vaporized solvent, vaporized resins and oils and fine particle size asphaltenes and resins separate from the bulk of the fluid-like asphaltenes and resins and rise to an upper portion of steam stripper 28. The asphaltenes and resins settle within the apparatus and collect in a bottom portion of steam stripper 28. The steam rises upwardly through the settling asphaltenes and resins and causes at least a portion of any remaining solvent associated therewith to be vaporized. The bulk of the fluid-like asphaltenes and resins are withdrawn from the bottom portion of stripper 28 through a conduit 34 for recovery. The vaporized solvent, vaporized resins and oils, steam and fine particle size asphaltenes and resins are withdrawn from steam stripper 28 through a conduit 32 and introduced into a solvent condenser 36.

In solvent condenser 36, the vaporized solvent, vaporized resins and oils and steam are condensed into a liquid mixture. At least a portion of the fluid-like fine particle size asphaltenes and resins carried-over from steam stripper 28 solidify and an emulsion of water and fluid-like asphaltenes, resins and oils is formed. The liquid mixture is withdrawn from solvent condenser 36 through a conduit 38 and introduced into a third separation zone 40.

In separation zone 40 the solvent is separated from the emulsion, water and solids and is withdrawn through a conduit 42 for introduction into a solvent surge vessel 44. The separated water, emulsion and solids are withdrawn from the separation zone 40 through a conduit 46 and can be sewered or disposed of in any other suitable manner.

Figure 2:
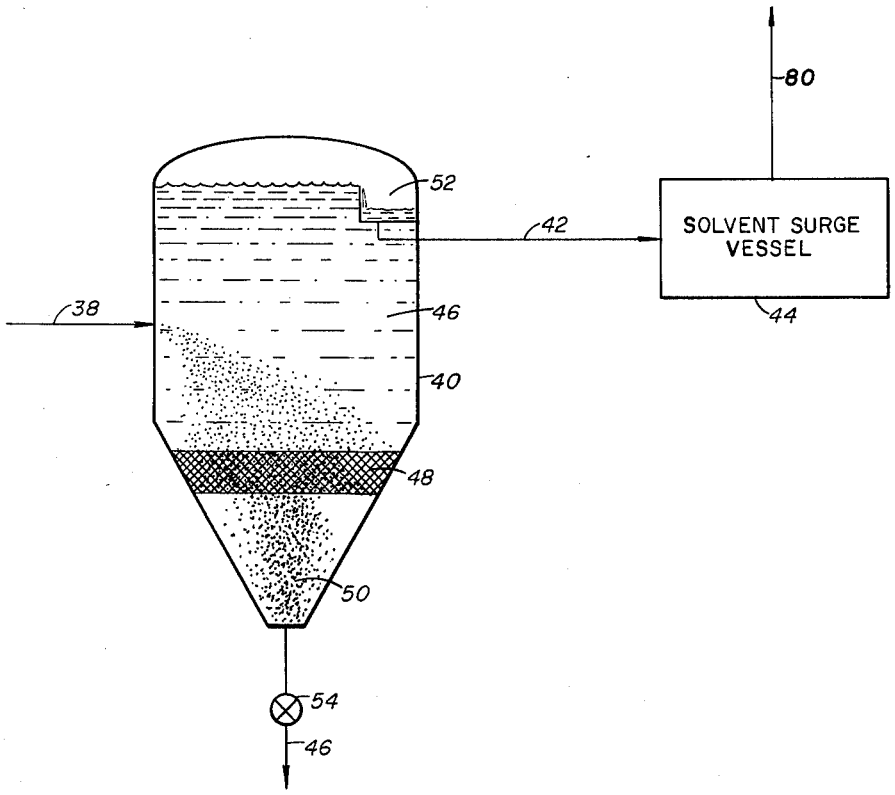
FIG. 2 is a diagrammatic illustration of a cone-bottomed liquid-liquid separation vessel suitable for use in this invention.

More particularly, referring now to FIG. 2, the liquid mixture is introduced into an upper portion of separation zone 40. Separation zone 40 preferably comprises a vessel having a conical lower portion. The liquid mixture separates within zone 40 to form three distinct fractions or layers; (1) An uppermost fraction 46 comprising solvent, (2) a middle fraction 48 comprising an emulsion of water, asphaltenes, resins and some oils and (3) a lower fraction 50 comprising water in which the solidified asphaltenes and resins collect. The liquid mixture is introduced into the lower portion of the solvent fraction 46 within separation zone 40. The emulsion, water and solids rapidly settle from the solvent fraction 46 due to the differing densities of the materials and accumulate in their respective fractions in zone 48. The slope of the conical portion of the separation vessel comprising zone 40 is selected such that it substantially exceeds the angle of repose of the solidified particles of bituminous material. This ensures that the solids readily collect in the lowest portion of the separation vessel.

The solvent is removed from zone 40 by passage over a weir 52 after which it is withdrawn from zone 40 through a conduit 42 for storage in solvent surge vessel 44. The emulsion fraction 48 and water fraction 50 can be discharged from zone 40 through a conduit 46. The discharge can be regulated by a valve 54 interposed in conduit 46 that is regulated by a level controller (not shown) in the water fraction 50 or emulsion fraction 48 of zone 40. To facilitate water removal, the level controller normally is positioned to control the level of water fraction 50. This permits the emulsion to accumulate in zone 40. Then, to remove the accumulated emulsion fraction 48, separation zone 40 periodically is blown down by draining the water and emulsion fractions through conduit 46 until the solvent fraction is found to exit through valve 54.

The utilization of separation zone 40 permits an efficient removal of the emulsion and solidified asphaltene and resin particles from the solvent and eliminates the possibility of emulsion or particle carry-over to the solvent surge vessel.

Referring now to FIG. 1, the separated first light phase is withdrawn from the first separation zone 18 through a conduit 20 and introduced into a second separation zone 22. In one particular embodiment, the second separation zone 22 is maintained at a temperature level higher than the temperature level in the first separation zone 18 and at an elevated pressure to effect a separation of the first light phase into a second light phase comprising solvent and a fluid-like second heavy phase comprising oils and some solvent. The second light phase is withdrawn from the second separation zone 22 through a conduit 56 for recycle in the process. The second heavy phase is withdrawn through a conduit 58 for additional treatment.

The second separation zone 22 is maintained at a temperature level in the range of from about 25 degrees F. above the temperature level in the first separation zone 18 to above the critical temperature of the solvent. The pressure level of second separation zone 22 is maintained at least equal to the vapor pressure of the solvent when zone 22 is maintained at a temperature below the critical temperature of the solvent and at least equal to the critical pressure of the solvent when maintained at a temperature equal to or above the critical temperature of the solvent. The pressure level in the second separation zone 22 can be substantially the same pressure level as is maintained in first separation zone 18.

On the illustrated embodiment, a pressure reduction valve 60 is interposed in conduit 58 to reduce the pressure of the second heavy phase. Preferably, the pressure level of the second heavy phase is reduced to a level of from about 0 to 50 psig. The pressure reduction vaporizes a substantial portion of the solvent in the second heavy phase, however, a small quantity of solvent remains. The pressure reduction also vaporizes a small portion of the oils. The second heavy phase then is introduced into a steam stripper 62.

In stripper 62, the vaporized solvent and oil separates from the remaining oils and rises to an upper portion of stripper 62. The oils settle within the apparatus and collect in a bottom portion of steam stripper 62. Steam is introduced into the bottom portion of stripper 62 by a conduit 64. The steam rises upwardly through the settling oils and causes at least a portion of any solvent remaining dissolved therein to vaporize. The oils are withdrawn from the bottom portion of stripper 62 through a conduit 66 for recovery.

The mixture of vaporized solvent, vaporized oils and steam is withdrawn from stripper 62 through a conduit 68 for introduction into a solvent condenser 70 and eventual recycle in the process. In condenser 70, the vaporized solvent, vaporized oils and steam condense to form a liquid mixture. The liquid mixture is withdrawn from condenser 70 through a conduit 72 and introduced into a solvent-water separator 74. The water is separated from the liquid solvent and oil in separator 74 and is withdrawn through a conduit 76 for disposal. The separated solvent and oil is withdrawn from separator 74 and introduced into solvent surge vessel 44 through a conduit 78. The solvent in surge vessel 44 is recycled to the mixing zone 12 through a conduit 80.

The small quantity of oils that accumulate in the solvent can be regulated by a solvent bleed (not shown) from surge vessel 44. The solvent bleed stream can be introduced into suitable distillation apparatus or simply flashed and then recondensed to remove the oils. The purified solvent then can be returned to the process.

In an alternate embodiment of the invention, the feed is caused to separate within first separation zone 18 into a first light phase comprising resins, oils and solvent and a first heavy phase comprising asphaltenes and some solvent. The separation is effected by maintaining the temperature level and pressure level within first separation zone 18 at predetermined elevated temperatures and pressures within the ranges previously described.

The first heavy phase is withdrawn from first separation zone 18 through conduit 24 and treated in the manner previously described for separation of the solvent from the heavy phase product of first separation zone 18. Any fine particle size asphaltenes formed during pressure reduction of the first heavy phase can be removed in third separation zone 40.

The first light phase is withdrawn from first separation zone 18 through conduit 20 and introduced into second separation zone 22. In second separation zone 22, the first light phase is caused to separate into a second light phase comprising solvent and a second heavy phase comprising resins, oils and some solvent through control of the temperature and pressure within zone 22.

The second light phase comprising solvent is withdrawn through conduit 58, reduced in pressure and introduced into steam stripper 62. In the event that pressure reduction of the second heavy phase results in the formation of fine particle size resins and oils in the vaporized solvent, the stream withdrawn from stripper 62 through conduit 68 can be introduced into conduit 32 for entry into solvent condenser 36 and third separation zone 40 rather than solvent condenser 70 (not shown). Alternatively, the mixture of vaporized solvent, steam and fine particle size resins and oils can be condensed in solvent condenser 70 and then introduced into third separation zone 40 (not shown). Thus, any fine particle size resins and oils contained in the mixture of vaporized solvent and steam can be removed prior to recycle of the solvent.

In yet another embodiment of the invention (not shown), the mixture of atmospheric residuum and solvent is separated into a fluid-like first light phase comprising resins, oils and solvent and a fluid-like first heavy phase comprising asphaltenes and some solvent through control of the temperature and pressure within a first separation zone as previously described.

The first heavy phase is withdrawn from the first separation zone and treated in the manner previously described for separation of the solvent from the heavy phase product of first separation zone 18.

The first light phase is withdrawn from the first separation zone and introduced into a second separation zone. The second separation zone is maintained at a temperature level higher than the temperature level of the first separation zone. The pressure level of the second separation zone is maintained at least equal to the vapor pressure of the solvent when the second separation zone is maintained at a temperature below the critical temperature of the solvent and at least equal to the critical pressure of the solvent when the second separation zone is maintained at a temperature equal to or above the critical temperature of the solvent. The particular conditions of temperature and pressure within the second separation zone are selected to cause the first light phase to separate into a second light phase comprising oils and solvent and a second heavy phase comprising resins and some solvent.

The second heavy phase comprising resins and some solvent is withdrawn from the second separation zone and treated to recover the solvent in the manner previously described for separation of the solvent from the heavy phase product of first separation zone 18. Any fine particle size resins that are formed during recovery of the solvent can be removed by a separation effected in a treatment zone similar to previously described third separation zone 40.

The second light phase comprising oils and solvent is withdrawn from the second separation zone and introduced into another separation zone. This separation zone is maintained at a higher temperature level than the temperature level of the second separation zone. The pressure level of this separation zone is maintained at least equal to the vapor pressure of the solvent when the separation zone is maintained at a temperature below the critical pressure of the solvent and at least equal to the critical pressure of the solvent when maintained at a temperature equal to or above the critical temperature of the solvent. The particular conditions of temperature and pressure are selected to effect a separation of the second light phase into another light phase comprising solvent and a heavy phase comprising oils and some solvent. The solvent can be withdrawn from the separation zone and recycled in the process. The heavy phase comprising oils and some solvent is withdrawn from the separation zone and treated to recover the solvent by pressure reduction and steam stripping. Any fine particle size oils that are formed during recovery of the solvent can be removed by a separation effected in a treatment zone similar to previously described third separation zone 40.

To further illustrate the present invention and not by way of limitation, the following Example is provided.

EXAMPLE

Two tests are preformed to determine the effect of the present invention upon a bituminous separation process.

In the first test, a feed comprising an atmospheric residuum is contacted and admixed with a solvent comprising pentane in an amount sufficient to provide a solvent to feed ratio, by volume of 10:1. The feed mixture continuously is introduced into a first separation zone maintained at a temperature level of about 425 degrees F. and a pressure of about 650 psig. The feed mixture separates into a first light phase and a first heavy phase comprising asphaltenes, resins and solvent. The first heavy phase continuously is withdrawn from the first separation zone and passed through a pressure reduction valve to reduce the pressure level of the first heavy phase to 15 psig. The first heavy phase then is introduced into a steam stripper. Steam is introduced into the lower portion of the steam stripper at a pressure of 15 psig. The steam strips solvent remaining in the asphaltenes and resins and the vaporized solvent and steam are withdrawn and introduced into a solvent condenser. The solvent and steam are condensed and then are introduced into a solvent surge vessel having a water draw. After 48 hours of continuous operation, the solvent surge vessel is inspected and is found to contain a layer of emulsion and a deposit of fine particle size asphaltenes and resins which has collected therein.

A second test then is run, in accordance with the process of this invention, in which the separation zone of the present invention as illustrated in FIG. 2 is installed in the process apparatus. The conditions are maintained as in the first test. A portion of the water and emulsion layers continuously are withdrawn from the separation zone 40 through conduit 46. After 96 hours, process operation is discontinued and the interior of the solvent surge vessel 44 is inspected. The solvent surge vessel is found not to contain any emulsion or asphaltene and resin particles.

The foregoing Example clearly illustrates the benefit which is to be derived from the use of the present invention. The present invention permits continuous operation of the bituminous separation process by separating the fine solid particles and emulsion from the solvent to thereby avoid carry-over of the fine particles or emulsion into the solvent recovery apparatus of the process.

The term "bituminous material" as used herein means pyrogenous bitumens and native bitumens, one or more fractions or components thereof, products obtained by treating these materials or one or more of their components or fractions with air or another oxygen containing gas in the presence or absence of catalysts and products obtained by otherwise treating these materials. The pyrogenous bitumens include heavy or very low API gravity petroleum crudes, reduced crudes, either steam or vacuum refined, hard and soft wood pitches, coal tar residues, cracked tars, tall oil and the like. The native bitumens include gilsonite, wurtzilite, albertite and native asphalt, for instance, Trinidad asphalt and the like. Suitable catalysts include, for example, phosphorus pentoxide, ferric chloride, cobaltic salts and the like. The term "otherwise treating" as used herein includes, for example, condensation of asphalt-type material in the presence of a suitable treating agent to produce heavier or more complex materials. Examples of suitable treating agent are catalysts of the Friedel-Craft type.

The term "solvent" as used herein means a fluid comprising at least one member selected from the group consisting of: aromatic hydrocarbons having normal boiling points below 350 degrees F., such as benzene, toluene, o-, m- and p-xylene and isopropyl benzene; paraffin hydrocarbons containing from 3 through 9 carbon atoms, such as propane, butane, pentane, hexane, heptane, octane and nonane; and mono-olefin hydrocarbons containing from 4 to 8 carbon atoms, such as butene, pentene, hexene, heptene and octene and other related organic compounds such as alcohols containing 3 through 9 carbon atoms and the like.

While the present invention has been described with respect to what at present is the preferred embodiment thereof, it will be understood, of course, that certain changes, substitutions, modifications and the like may be made therein without departing from its true scope as defined in the appended claims.

What is claimed is:

1. A process comprising:

separating an admixture comprising a bituminous material and a solvent in a first separation zone into a fluid-like first light phase comprising solvent and at least a portion of said bituminous material of said admixture and a fluid-like first heavy phase comprising the remainder of said bituminous material and some solvent by maintaining the admixture at an elevated temperature and pressure;

reducing the pressure of said fluid-like first heavy phase to vaporize at least a portion of the solvent present therein and form a mixture comprising fluid-like bituminous material in association with said vaporized solvent together with undesired fine particles of bituminous material dispersed therein;

introducing said mixture into a steam stripper;

introducing steam into said steam stripper to contact said mixture to vaporize at least a portion of any nonvaporized solvent remaining therein and to form at least one stream comprising fluid-like bituminous material and one other stream comprising steam and vaporized solvent together with said undesired fine particles of bituminous material;

introducing said stream comprising steam, vaporized solvent and said fine particles of bituminous material into a condenser to form a liquid mixture comprising water, solvent, solidified fine particles of bituminous material and an emulsion of water and bituminous material;

introducing said liquid mixture comprising said water, solvent, solids and emulsion into a second separation zone to separate said liquid mixture into at least three fractions comprising a solvent fraction, an emulsion fraction and a water fraction which includes the solidified fine particles of bituminous material; and recovering said solvent fraction from said second separation zone, said solvent being substantially free of fine particles of bituminous material.

2. The process of claim 1 wherein the solvent comprises at least one member selected from the group consisting of aromatic hydrocarbons having normal boiling points below 350 degrees F., paraffin hydrocarbons containing from 3 through 9 carbon atoms, mono-olefin hydrocarbons containing from 4 to 8 carbon atoms, and alcohols containing from 3 through 9 carbon atoms.

3. The process of claim 1 wherein the elevated temperature and pressure at which the admixture in the first separation zone is maintained is defined further as a temperature in the range of from about 150 degrees F. to above the critical temperature of the solvent and a pressure at least equal to the vapor pressure of the solvent when the admixture is maintained at a temperature below the critical temperature of the solvent and at least equal to the critical pressure of the solvent when maintained at a temperature equal to or above the critical temperature of the solvent.

4. The process of claim 1 wherein the pressure at which the admixture in the first separation zone is maintained is above the critical pressure of the solvent.

5. The process of claim 1 wherein the second separation zone comprises a vessel having a generally conical lower portion and a generally cylindrical upper portion and introducing said liquid mixture into said second separation zone is defined further as:

introducing said liquid mixture into the upper portion of said second separation zone to effect a separation of said mixture into an uppermost fraction comprising solvent, a middle fraction comprising emulsion and a lower fraction comprising water and solids.

6. A process comprising:

separating an admixture comprising a bituminous material and a solvent in a first separation zone into a fluid-like first light phase comprising solvent and at least a portion of said bituminous material of said admixture and a fluid-like first heavy phase comprising the remainder of said bituminous material and some solvent by maintaining the admixture at an elevated temperature and pressure;

introducing said first light phase into a second separation zone maintained at a temperature level above the temperature in said first separation zone and at an elevated pressure to effect a separation of said first light phase into a second light phase comprising solvent and a second heavy phase comprising at least a portion of said fluid-like bituminous material of said first light phase and some solvent;

reducing the pressure of said fluid-like second heavy phase to vaporize at least a portion of the solvent present therein and form a mixture comprising fluid-like bituminous material in association with said vaporized solvent together with undesired fine particles of bituminous material dispersed therein;

introducing said mixture into a steam stripper;

introducing steam into said steam stripper to contact said mixture to vaporize at least a portion of any nonvaporized solvent remaining therein and to form at least one stream comprising fluid-like bituminous material and one other stream comprising steam and vaporized solvent together with said undesired fine particles of bituminous material;

introducing said stream comprising steam, vaporized solvent and said fine particles of bituminous material into a condenser to form a liquid mixture comprising water, solvent, solidified fine particles of bituminous material and an emulsion of water and bituminous material;

introducing said liquid mixture comprising said water, solvent, solids and emulsion into a third separation zone to separate said liquid mixture into at least three fractions comprising a solvent fraction, an emulsion fraction and a water fraction which includes the solidified fine particles of bituminous material; and recovering said solvent fraction from said third separation zone, said solvent being substantially free of fine particles of bituminous material.

7. The process of claim 6 wherein the solvent comprises at least one member selected from the group consisting of aromatic hydrocarbons having normal boiling points below 350 degrees F., paraffin hydrocarbons containing from 3 through 9 carbon atoms, monoolefin hydrocarbons containing from 4 to 8 carbon atoms, and alcohols containing from 3 through 9 carbon atoms.

8. The process of claim 6 wherein the elevated temperature and pressure at which the admixture in the first separation zone is maintained is defined further as a temperature in the range of from about 150 degrees F. to above the critical temperature of the solvent and a pressure at least equal to the vapor pressure of the solvent when the admixture is maintained at a temperature below the critical temperature of the solvent and at least equal to the critical pressure of the solvent when maintained at a temperature equal to or above the critical temperature of the solvent.

9. The process of claim 6 wherein the temperature level and pressure of the second separation zone are maintained above the critical temperature and pressure of the solvent.

10. The process of claim 6 wherein the third separation zone comprises a vessel having a generally conical lower portion and a generally cylindrical upper portion and introducing said liquid mixture into said third separation zone is defined further as:

introducing said liquid mixture into the upper portion of said third separation zone to effect a separation of said mixture into an uppermost fraction comprising solvent, a middle fraction comprising emulsion and a lower fraction comprising water and solids.

11. A process comprising:

separating an admixture comprising (i) a bituminous material comprising asphaltenes, resins and oils and (ii) a solvent in a first separation zone into a fluid-like first light phase comprising oils and solvent and a first heavy phase comprising asphaltenes, resins and some solvent by maintaining the admixture at an elevated temperature and pressure;

reducing the pressure of said first heavy phase to vaporize at least a portion of the solvent present therein and form a mixture comprising fluid-like asphaltenes and resins in association with said vaporized solvent together with undesired fine particles of asphaltenes and resins;

introducing said mixture into a steam stripper;

introducing steam into said steam stripper to contact said mixture to vaporize at least a portion of any nonvaporized solvent remaining therein and to form at least one stream comprising fluid-like asphaltenes and resins and one other stream comprising steam and vaporized solvent together with said undesired fine particles of asphaltenes and resins;

introducing said stream comprising steam, vaporized solvent and said fine particles of asphaltenes and resins into a condenser to form a liquid mixture comprising water, solvent, solidified fine particles of asphaltenes and resins and a emulsion comprising water and asphaltenes and resins;

introducing said liquid mixture into a second separation zone to separate said liquid mixture into at least three fractions comprising a solvent fraction, an emulsion fraction and a water fraction which includes the solidified fine particles of asphaltenes and resins; and recovering said solvent fraction from said second separation zone, said solvent being substantially free of fine particles of asphaltenes and resins.

12. The process of claim 11 wherein the solvent comprises at least one member selected from the group consisting of aromatic hydrocarbons having normal boiling points below 350 degrees F., paraffin hydrocarbons containing from 3 through 9 carbon atoms, monoolefin hydrocarbons containing from 4 to 8 carbon atoms, and alcohols containing from 3 through 9 carbon atoms.

13. The process of claim 11 wherein the elevated temperature and pressure at which the admixture in the first separation zone is maintained is defined further as a temperature in the range of from about 150 degrees F. to above the critical temperature of the solvent and a pressure at least equal to the vapor pressure of the solvent when the admixture is maintained at a temperature below the critical temperature of the solvent and at least equal to the critical pressure of the solvent when maintained at a temperature equal to or above the critical temperature of the solvent.

14. A process comprising:

separating an admixture comprising (i) a bituminous material comprising asphaltens, resins and oils and (ii) a solvent in a first separation zone into a fluid-like first light phase comprising resins, oils and solvent and a fluid-like first heavy phase comprising asphaltenes and some solvent by maintaining the admixture at an elevated temperature and pressure;

introducing said first light phase into a second separation zone maintained at a temperature level above the temperature in said first separation zone and an elevated pressure to form a second light phase comprising solvent and some oils and a second heavy phase comprising resins, oils and some solvent;

reducing the pressure on said second heavy phase to vaporize at least a portion of the solvent present therein and form a mixture comprising fluid-like resins and oils in association with said vaporized solvent together with undesired fine particles of resins and oils dispersed therein;

introducing said mixture into a steam stripper;

introducing steam into said steam stripper to contact said mixture to vaporize at least a portion of any nonvaporized solvent remaining therein and to form at least one stream comprising fluid-like resins and oils and one other stream comprising steam and vaporized solvent together with said fine particles of resins and oils;

introducing said stream comprising steam, vaporized solvent and said fine particles of resins and oils into a condenser to form a liquid mixture of water, solvent, solidified fine particles of resins and oils and an emulsion comprising water, resins and oils;

introducing said liquid mixture comprising said water, solvent, solids and emulsion into a third separation zone to separate said liquid mixture into at least three fractions comprising a solvent fraction, an emulsion fraction and a water fraction which includes the solidified fine particles of resins and oils; and recovering said solvent fraction from said third separation zone, said solvent being substantially free of fine particles of resins and oils.

15. The process of claim 14 wherein the solvent comprises at least one member selected from the group consisting of aromatic hydrocarbons having normal boiling points below 350 degrees F., paraffin hydrocarbons containing from 3 through 9 carbon atoms, monoolefin hydrocarbons containing from 4 to 8 carbon atoms, and alcohols containing from 3 through 9 carbon atoms.

16. The process of claim 14 wherein the elevated temperature and pressure at which the admixture in the first separation zone is maintained is defined further as a temperature in the range of from about 150 degrees F. to above the critical temperature of the solvent and a pressure at least equal to the vapor pressure of the solvent when the admixture is maintained at a temperature below the critical temperature of the solvent and at least equal to the critical pressure of the solvent when maintained at a temperature equal to or above the critical temperature of the solvent.

17. The process of claim 14 wherein the temperature level and pressure of the second separation zone are maintained above the critical temperature and pressure of the solvent.

18. The process of claim 14 wherein the third separation zone comprises a vessel having a generally conical lower portion and a generally cylindrical upper portion and introducing said liquid mixture into said third separation zone is defined further as:

introducing said liquid mixture into the upper portion of said third separation zone to effect a separation of said mixture into an uppermost fraction comprising solvent, a middle fraction comprising emulsion and a lower fraction comprising water and solids.

19. A process comprising:

separating an admixture comprising (i) a bituminous material comprising asphaltenes, resins and oils and (ii) a solvent in a first separation zone into a fluid-like first light phase comprising resins, oils and solvent and a fluid-like first heavy phase comprising asphaltenes and some solvent by maintaining the admixture at an elevated temperature and pressure;

reducing the pressure on said first heavy phase to vaporize at least a portion of the solvent present therein and form a mixture comprising fluid-like asphaltenes in association with said vaporized solvent together with undesired fine particles of asphaltenes dispersed therein;

introducing said mixture into a steam stripper;

introducing steam into said steam stripper to contact said mixture to vaporize at least a portion of any nonvaporized solvent remaining therein and to form at least one stream comprising fluid-like asphaltenes and one other stream comprising steam and vaporized solvent together with said undesired fine particles of asphaltenes;

introducing said stream comprising steam, vaporized solvent and said fine particles of asphaltenes into a condenser to form a liquid mixture of water, solvent, solidified fine particles of asphaltenes and an emulsion comprising water and asphaltenes;

introducing said liquid mixture comprising water, solvent, solids and emulsion into a second separation zone to separate said liquid mixture into at least three fractions comprising a solvent fraction, an emulsion fraction and a water fraction which includes the solidified fine particles of asphaltenes; and recovering said solvent fraction from said second separation zone, said solvent being substantially free of fine particles of asphaltenes.

20. The process of claim 19 wherein the solvent comprises at least one member selected from the group consisting of aromatic hydrocarbons having normal boiling points below 350 degrees F., paraffin hydrocarbons containing from 3 through 9 carbon atoms, monoolefin hydrocarbons containing from 4 to 8 carbon atoms, and alcohols containing from 3 through 9 carbon atoms.

21. The process of claim 19 wherein the elevated temperature and pressure at which the admixture in the first separation zone is maintained is defined further as a temperature in the range of from about 150 degrees F. to above the critical temperature of the solvent and a pressure at least equal to the vapor pressure of the solvent when the admixture is maintained at a temperature below the critical temperature of the solvent and at least equal to the critical pressure of the solvent when maintained at a temperature equal to or above the critical temperature of the solvent.

22. The process of claim 19 wherein the pressure at which the admixture in the first separation zone is maintained is above the critical pressure of the solvent.

23. The process of claim 19 wherein the second separation zone comprises a vessel having a generally conical lower portion and a generally cylindrical upper portion and introducing said liquid mixture into said second separation zone is defined further as:

introducing said liquid mixture into the upper portion of said second separation zone to effect a separation of said mixture into an uppermost fraction comprising solvent, a middle fraction comprising emulsion and a lower fraction comprising water and solids.

* * * * *